United States Patent [19]

Lundergan et al.

[11] Patent Number: 4,640,567

[45] Date of Patent: Feb. 3, 1987

[54] DETACHABLE SEALED MULTICONTACT ELECTRICAL CONNECTOR

[75] Inventors: Robert G. Lundergan, Kernersville, N.C.; Donald W. McClune, Winston-Salem, N.J.

[73] Assignee: AMP Incorporated, Harrisburg, Pa.

[21] Appl. No.: 854,719

[22] Filed: Apr. 16, 1986

Related U.S. Application Data

[63] Continuation of Ser. No. 696,286, Jan. 30, 1985, abandoned.

[51] Int. Cl.[4] ..... H01R 4/00

[52] U.S. Cl. ..... 339/94 M; 339/60 M; 339/206 P

[58] Field of Search ..... 339/94, 60, 61, 62, 339/63, 206 P

[56] References Cited

U.S. PATENT DOCUMENTS

| | | | |
|---|---|---|---|
| 3,576,517 | 4/1971 | Johnson et al. | 339/94 R |
| 3,787,796 | 1/1974 | Barr | 339/94 R |
| 4,150,866 | 4/1979 | Snyder et al. | 339/94 M |
| 4,193,655 | 3/1980 | Herrmann, Jr. | 339/94 M |
| 4,497,531 | 2/1985 | Baker | 339/94 M |

*Primary Examiner*—Gil Weidenfeld
*Assistant Examiner*—David L. Pirlot
*Attorney, Agent, or Firm*—Robert W. Pitts; Eric J. Groen

[57] ABSTRACT

Multicontact detachable sealed electrical connector having two connector halves receiving male and female terminals therein is used to establish a sealed interconnection between conductors in one or more circuits. Conductors in separate circuits are separately sealed, and sealing integrity can be maintained even though less than all of the circuits are interconnected. Terminals are received within cavities in the housing and one housing has a plurality of tubular protuberances defining a cavity extension. Inner seals are positioned around these protuberances and are deflected when partially received within the cavity in the other housing to maintain separate sealing integrity at the interface between the two connectors.

10 Claims, 4 Drawing Figures

2
4
6
8
10
10a
12
12a
14
20
22
24
26
28
30
32
35
36
37
40
42
44
48
50
52
54
56
58
60
62
66
68
70
72
74
80
90

DETACHABLE SEALED MULTICONTACT ELECTRICAL CONNECTOR

This application is a continuation of application Ser. No. 696,286 filed Jan. 30, 1985 now abandoned.

BACKGROUND OF THE INVENTION

1. Field of the Invention

This invention relates to electrical connectors for use in establishing electrical continuity on a plurality of separate lines or circuits in a single detachable sealed multicontact electrical connector.

2. Description of the Prior Art

U.S. Pat. No. 4,150,866 discloses a multicontact sealed detachable electrical connector having a plurality of male and female terminals separately located in matable multicavity housings. The electrical connector shown therein employs seals at the outer face of both connector halves to establish sealing integrity with each round wire conductor as it enters the corresponding terminal cavity. Sealing integrity is maintained at the interface between the two connector housings by a single O-ring positioned at the mating face of the two housings. If one of the seals at the end of the housings cavities engaging the round wire conductor were to fail, sealing integrity would be lost for all of the conductors.

U.S. Pat. No. 3,221,292 discloses a detachable multicontact electrical connector employing a unitary grommet at each end of the connector halves to maintain sealing integrity with the wires leading into the plurality of cavities in the connector. Sealing integrity is maintained around the exterior of the connector by a peripheral O-ring seal. To the extent sealing integrity is maintained between separate lines in this connector, sealing integrity must be maintained at the faces of intermediate grommets in separate connector parts. It does not appear however that sealing integrity is to be maintained between separate lines interconnected by mating male and female terminals.

U.S. Pat. No. 3,697,928 also discloses a detachable multicontact electrical connector having sealing grommets at the rearward end of two connector halves for maintaining sealing integrity with the wires extending into cavities in the connector half. A peripheral O-ring seal is provided between the exterior of the male connector half and the encircling flange of the female connector half to establish peripheral sealing integrity.

Other multicontact connectors employ a single face seal between mating faces of male and female connector halves to establish sealing integrity between terminals in opposite connecting halves at the interface. However these interfacial seals are intended to maintain the sealing integrity between all of the lines in the connector and do not ensure sealing integrity when one or more of a plurality of lines in a multicontact connector are not present.

SUMMARY OF THE INVENTION

A multicontact detachable sealed electrical connector such as a pin and socket connector which might be used in an electrical harness in an automobile is used to establish a sealed interconnection between conductors in one or more circuits. The preferred embodiment of this invention comprises a four position electrical connector comprising a male and female mating connector half each containing mating electrical terminals. In the preferred embodiment of this invention, pin and socket mating terminals are employed. The four position electrical connector shown in the preferred embodiment of this invention is suitable for use with four pairs of terminals or fewer than four pairs of terminals. Even when three or fewer terminals are contained within the housing, sealing integrity is maintained relative to each circuit formed by interconnecting terminals. An outer seal establishes sealing integrity with the conductor on the outer face of the male and female connector halves. An inner seal establishes separate sealing integrity at the interface between the male and female connector halves for each circuit. In the preferred embodiment of this invention, terminals in one of the housings are positioned within a tubular protuberance which comprises an extension of a cavity extending from an outer face to the intermating face of the connector half. The corresponding terminal is located within the cavity and within the cavity extension defined by a tubular protuberance. A seal extends around the exterior of the tubular protuberance and when the connector halves are mated this seal is deflected to maintain sealing integrity between the two connector halves for each circuit. An annular shoulder on the exterior of each tubular protuberance is partially received within a cavity in the other connector half and the seal is deflected between the annular shoulder and the enlarged end of the corresponding cavity on the other connector half.

BRIEF DESCRIPTION OF THE DRAWINGS

FIG. 3 is a view similar to FIG. 2 showing the position of the terminals in the housing as shown in FIG. 2.

DETAILED DESCRIPTION OF THE PREFERRED EMBODIMENT

Figure 1:
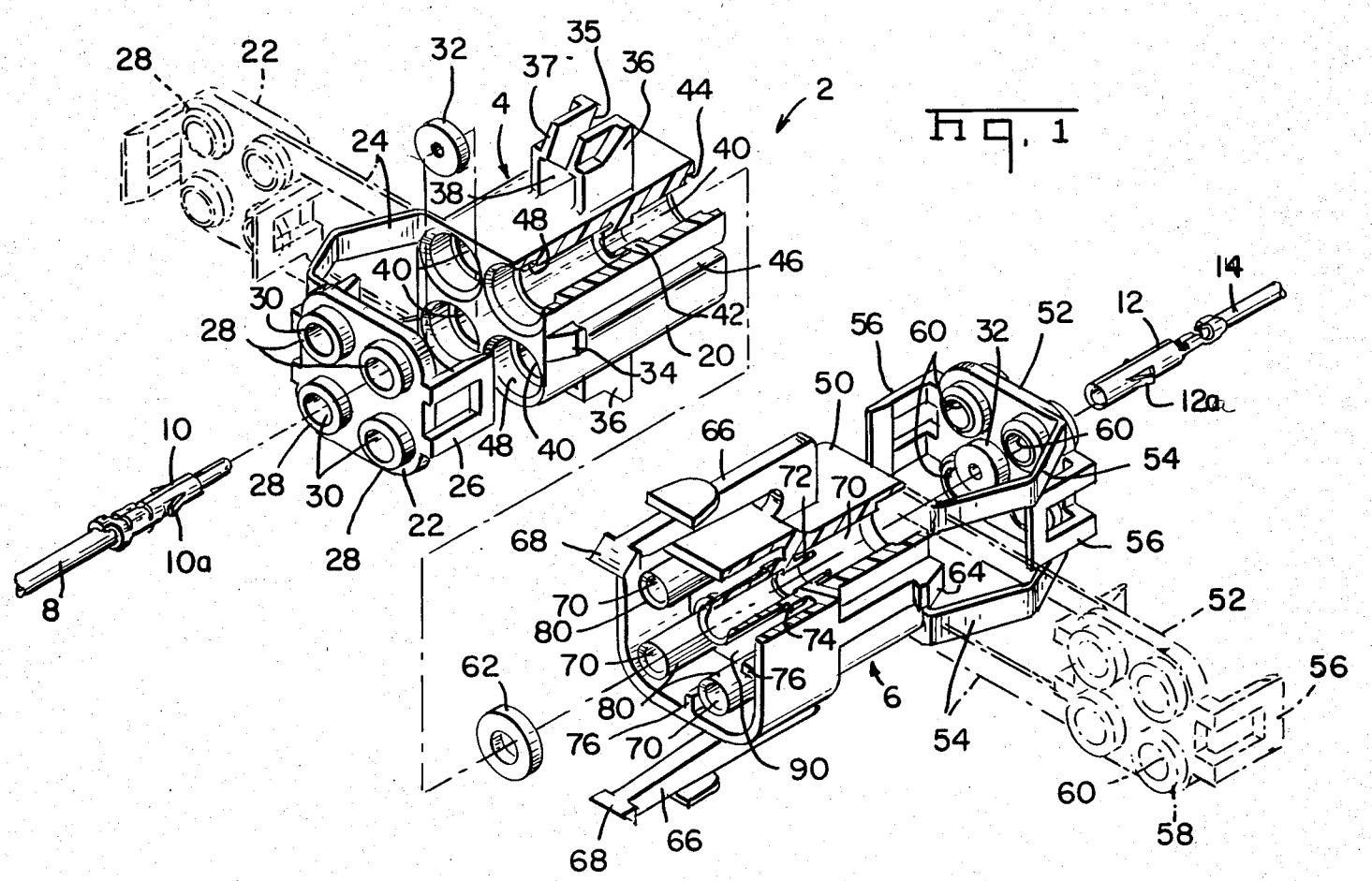
FIG. 1 is an exploded perspective view of the seal connector showing mating connector halves and a single terminal pair insertable into corresponding connector halves.

The preferred embodiment of this invention comprises a pin and socket multicontact detachable electrical connector having the capability of sealing individual circuits formed by mating terminals. The connector 2 shown in the preferred embodiment comprises a female connector half 4 matable with a male connector half 6. A conductor 8 can be terminated to a conventional pin terminal 10. Similarly a second conductor 14 to form a part of the same circuit as conductor 8, can be terminated at conventional means to a conventional socket terminal 12. Terminals 10 and 12 can then be inserted into corresponding terminal receiving cavities 40 and 70 in the respective connector halves.

Female connector half 4 comprises a body 20 and a cover member 22 interconnected by an integral flexible hinge 24. Body 20, cover 22 and hinge 24 are preferably molded as an integral member formed of a conventional insulating plastic. The cover member 22 has cylindrical elements projecting through a flat base. Each cylindrical element 28 surrounds an axial bore 30. In the preferred embodiment, four axial bores, each capable of receiving a conductor 8 and a terminal 10 therethrough are located on cover 22. As shown in FIG. 1, hinge 24 is flexible to permit axial alignment of the cover 22 with the base 20. Base 20 has a like number of axially extending terminal receiving cavities 40 extending from an exterior end adjacent cover 22 to an interior end which can be disposed adjacent a similar end on the opposite connector half. Each terminal receiving cavity 40 comprises a cylindrical bore having an integrally molded retaining member 42 located intermediate the ends thereof. Terminal receiving cavities 40 are of substantially the same diameter throughout the length thereof, except for a portion adjacent the interior end wherein a recess 44 having a diameter greater than the inner diameter of the cavity bore is defined at the inner end. On the outer end of the female connector half 20, a seal receiving counterbore 48 is defined at each cavity. A cylindrical seal 32 having a terminal and conductor-receiving aperture therein is dimensioned for receipt within counterbore 48.

Figures 1, 2:
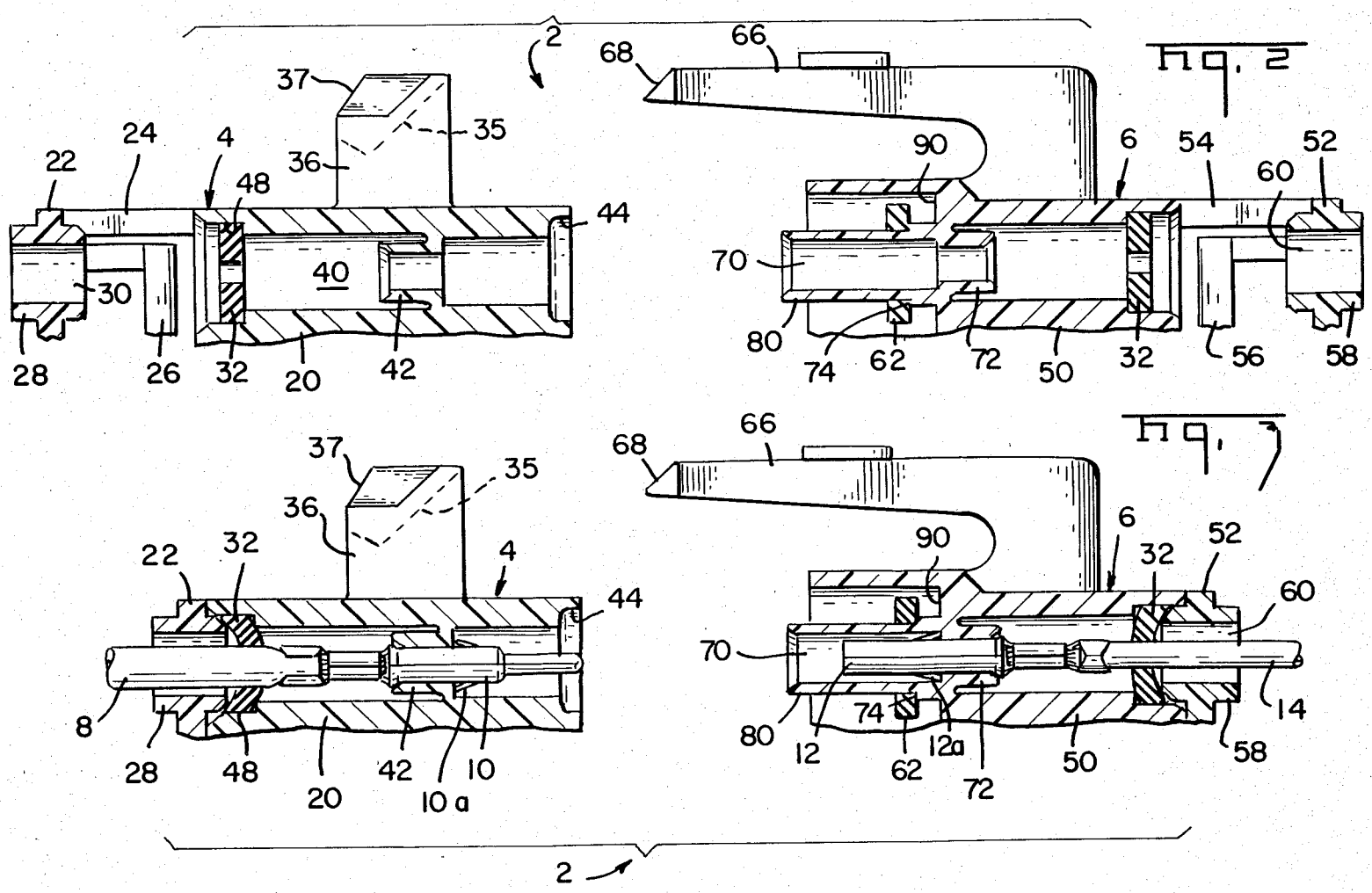
FIG. 2 is a view showing corresponding terminal receiving cavities for terminals used to interconnect conductors to form a single circuit.

An integrally molded latching member 36 comprising two side by side upstanding members is located on opposite sides of female connector half 20. A positive latching surface 37 shown in FIG. 2 is defined on the interior of latching member 36. The two side by side sections defining latching member 36 define an axially extending opening 38, from which the latching surface 37 extends. On the adjacent sides of the exterior of housing 20, polarizing grooves 46 extending along the length thereof are defined. In the preferred embodiment of this invention, a raised latching boss 34 is defined at the outer end of body 20. These latching bosses 34 are dimensioned for engagement with latching legs 26 molded on the cover 22.

The male connector half 6 similarly comprises integrally molded body 50, cover 52 and adjoining flexible hinge 54. Male connector half 6 is similarly molded from a conventional insulating material of the same fabrication as the female connector half 4. Cover member 52 is similar in construction to cover member 22 and in the preferred embodiment of the invention likewise comprises four cylindrical passages 60 adapted for alignment with cavities 70 extending through the body 50 of the male connector half. Hinge 54 permits alignment of the cover 52 with the male connector body 50. Cavities 70 in body 6 extend from an outer end adjacent cover 52 to an inner end intermediate the ends of body 6. A plurality of tubular protuberances 80 extend from the inner end of housing 6 and define extensions of cavity 70. A face 90 intermediate the ends of housing 50 defines the base of protuberances 80. A raised annular shoulder 74 having a diameter greater than the exterior diameter of the protuberances 80 is defined at face 90 on each protuberance 80. An integral retaining member 72 similar to retaining member 42 is defined within cavities 70 intermediate the outer end of body 50 and the end of the cavities as extended by protuberances 80. Cavities 70 are dimensioned to receive terminals 12, and the mating portion of terminals 12 are at least partially received within the extended cavities within protuberances 80. Protuberances 80 have an outer diameter less than the inner diameter of cavities 40 in housing 20.

Latching arms 66 are integrally molded on opposite sides of housing 50 and define flexible members having a camming wedge 68 at the distal end thereof. A pair of ribs 76 are defined adjacent protuberances 80 and are dimensioned for receipt in polarizing grooves 46 on the female connector half 20.

Cylindrical seals 32, are positioned on the back or exterior face of body 50 in the same manner as seals 32 are positioned on the rear end of the female connector body 20. A second inner set of seals 62 having an inner diameter less than the outer diameter of protuberances 80 are adapted to be inserted on the exterior of protuberances 80 in abutment with annular shoulder 74. When seals 62 are positioned in abutment with shoulder 74, the seal 62 would be located intermediate the end of the corresponding protuberance 80. The outer diameter of seal 62 is greater than the principal inner diameter of cavities 40 in female connector body 20. The outer diameter of seal 62 is also greater than the inner diameter of recesses 44 at the rear end of the cavities in female connector body 20.

After the respective conductors 8 and 14 are crimped or otherwise attached to corresponding terminals 10 and 12, the terminals may be inserted through perspective passages 30 and 60 in the integral cover members. Each terminal may then be inserted through the aperture in a resilient seal 32 positioned at the rear end of corresponding connector housings 20 and 50. Terminals 10 and 12 are dimensioned for receipt within the cavities 40 and 70 extending through the respective connector members. Deflectable lances 10A and 12A are located on each terminal and are dimensioned for a snap fit relative to the retaining members 42 and 72 defined within corresponding cavities. Thus axial insertion of terminals 10 and 12 into corresponding cavities 40 and 70 secures the respective terminals in corresponding connector halves. Each terminal 10 and 12 is located entirely within its corresponding cavities. Terminal 12 is located at least partially within the extended cavities 70 defined by protuberances 80 at the inner or mating end of the male connector half 50. Seals 32 engage the conductors 8 and 10 to maintain sealing integrity at the rearward end of each connector half. Covers 22 and 52 have been snap fit into engagement with housing bodies 20 and 50 with latches 26 and 56 engaging latching bosses 34 and 64 respectively. The conductors 8 and 12 extend respectively through passages 30 and 60 which serve to center the respective conductors to prevent radial deflection of the conductors within the aperture in seal 32 to ensure that sealing integrity is maintained around the peripheral of each conductor. With the conductors 8 and 14 and terminals 10 and 12 secured within their respective connector bodies, the male and female connector members can then be mated. As the mating for inner ends of the female connector half 4 and the male connector half 6 are brought into engagement, the resilient latching arms 66 on the male connector are received within the recess or opening 38 defined on the exterior of the female connector half 4. Camming members 68 are deflected inwardly by a camming surface 35 and upon relative movement of the latching arms 66 to a prescribed orientation relative to latching member 36, the camming member 68 is released for outward expansion to positively lock the connector halves together. Until the prescribed relative movement of the two connector halves towards each other, inward deflection of the camming member 68 and flexible arm 66 would tend to move or urge the connector halves apart. Thus the latching means provides a positive latch for the two connector halves.

Figure 4:
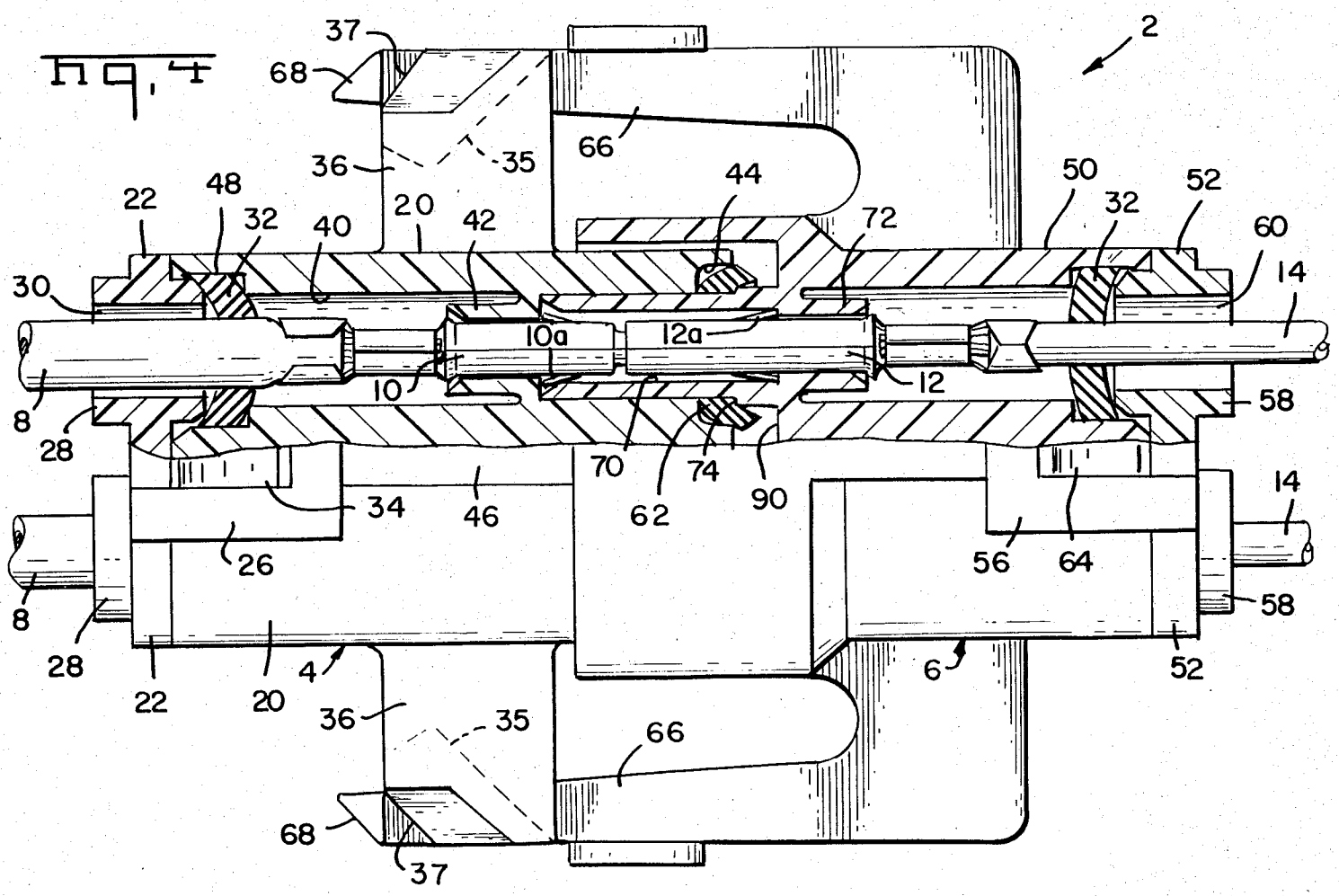
FIG. 4 is a view similar to FIGS. 2 and 3 but showing the connector halves and the terminals in mated configuration.

The inner seal 62 maintains sealing integrity between corresponding conductors 8 and 14 forming a single circuit essentially as shown in FIG. 4. When the connector halves are mated the initially planar annular seal 62 is deflected over the annular shoulder 74. Deflected seal 62 maintains sealing integrity even in the presence of anticipated movement or play between the mated connector halves and is consistent with acceptable manufacturing tolerances. Annular shoulder 74 and seal 62 are partially received within the enlarged recess 44 at the interface of the female connector half. Although seal 62 is formed of a resilient material, it is essentially incompressible. Thus the deflection of the seal rather than compression of seal 62 forms a fluid tight seal between surfaces on the exterior of the protuberances 80 and on the interface of the female connector adjacent the axially extending cavities. Thus a set of two outer seals 32 and a single inner seal 62 can separately seal a single circuit interconnected by pin and socket terminals 10 and 12. If sealing integrity is lost in one circuit, the other circuits are not affected. Furthermore it is not necessary to load every cavity of the mated connector halves in order to maintain sealing integrity for the connectors inserted therein.

Although the invention has been described in terms of a preferred embodiment, this embodiment is intended to be illustrative only, since numerous modifications could be made by one skilled in the art without departing from the scope of the invention as claimed herein.

What is claimed is:

1. A multicontact detachable sealed electrical connector for use in establishing a sealed interconnection between conductors in one or more circuits, comprising;

first and second mating connector housings formed of an insulative material, each having cavities extending from an exterior housing end therethrough to an interior housing end, each cavity having retaining means therein for attaching a corresponding terminal insertable therein to the housing, an outer seal aligned with each housing cavity at the exterior end of the housing, to establish sealing integrity between each conductor and the corresponding connector housing;

tubular protuberances on the interior end of the first connector housing defining an extension of each cavity therein, each tubular protuberance being insertable in the corresponding cavity adjacent the interior end of the second connector housing; and a deflectable inner seal surrounding each tubular protuberance, means maintaining said inner seal in position on each protuberance spaced from an interior end of said first connector housing, the inner seal having an outer dimension greater than the inner diameter of the cavity in the second housing, the inner seal having inner and outer peripheral surfaces and inner and outer facial surfaces, the outer peripheral surface being axially deflected toward said interior end, when the first and second connector housings are mated, whereby terminals interconnecting corresponding conductors forming each circuit are separately sealed.

2. The connector of claim 1 wherein the first terminal comprises a socket and the second terminal comprises a pin.

3. The connector of claim 1 wherein the first and second terminals ae retained entirely within the corresponding cavities in each connector housing.

4. A multicontact detachable sealed electrical connector for use in establishing a sealed interconnection between conductors in one or more circuits, comprising;

first and second mating connector housings formed of an insulative material, each having cavities extending from an exterior housing end therethrough to an interior housing end, each cavity having retaining means therein for attaching a corresponding terminal insertable therein to the housing, an outer seal aligned with each housing cavity at the exterior end of the housing, to establish sealing integrity between each conductor and the corresponding connector housing;

tubular protuberances on the interior end of the first connector housing defining an extension of each cavity therein, each tubular protuberance being insertable in the corresponding cavity adjacent the interior end of the second connector housing; and an inner seal surrounding each tubular protuberance, the inner seal having an outer dimension greater than the inner diameter of the cavity in the second housing, the inner seals being located intermediate the ends of each protuberance in abutment with an annular shoulder on the exterior of each protuberance having an outer dimension less than the outer dimension of the corresponding inner seal, the inner seal engaging the second connector housing at the inner end when the first and second connector housings are mated, whereby terminals interconnecting corresponding conductors forming each circuit are separately sealed.

5. The connector of claim 4 wherein an annular recess having an outer dimension greater than the inner diameter of the cavities in the second housing, surrounds each cavity at the interior second housing end, each inner seal being only partially insertable in each corresponding recess, each inner seal being deflectable around the exterior of the corresponding annular shoulder, sealing integrity being established between each corresponding annular shoulder and recess by the deflected inner seal.

6. The connector of claim 5 wherein each inner seal is cylindrical.

7. The connector of claim 6 wherein separate cylindrical inner seals surround each tubular protuberance.

8. The connector of claim 7 further comprising positive latching means on the first and second connector housings for intermating the first and second connector housings only upon prescribed relative minimum spacing between the first connector housing and the second connector housing, interengaging latching means urging the first connector housing away from the second connector housing when the first and second connector housings are spaced apart by a distance greater than the minimum spacing.

9. A detachable sealed electrical connector for use in establishing a sealed interconnection between two conductors, comprising:

first and second mating terminals attachable to separate conductors;

first and second mating insulating members surrounding each corresponding terminal, each having a cavity extending from an exterior end therethrough to an interior end, each cavity having retaining means for attaching the corresponding terminal insertable therein to the insulating member;

an outer seal between each insulating member and the corresponding conductor at the exterior end thereof;

a tubular protuberance on the interior end of one insulating member defining an extension of the cavity therein, each tubular protuberance being insertable in the cavity of the second insulating member;

an inner seal surrounding the tubular protuberance, the inner seal having an outer diameter greater than the inner diameter of the cavity in the other insulating member;

an annular shoulder on the exterior of the tubular protuberance having an outer diameter less than the outer diameter of the inner seal, the inner seal being located intermediate the ends of the protuberance in abutment with the annular shoulder; and a recess surrounding the cavity in the second insulating member having an outer diameter greater than the inner diameter of the housing in the second insulating member, the inner seal and the annular shoulder being at least partially received within the recess with the inner seal being deflected between the annular shoulder and the recess to seal the terminals at the interface between the first and second insulating members.

10. A multicontact detachable sealed electrical connector for use in establishing a sealed interconnection between conductors in one or more circuits, comprising;

first and second mating connector housings formed of an insulative material, each having cavities extending from an exterior housing end therethrough to an interior housing end, each cavity having retaining means therein for attaching a corresponding terminal insertable therein to the housing, sealing means at the exterior end of each housing for establishing sealing integrity between each conductor and the corresponding connector housing;

tubular protuberances on the interior end of the first connector housing defining an extension of each cavity therein, each tubular protuberance being insertable in the corresponding cavity adjacent the interior end of the second connector housing; and an inner seal surrounding each tubular protuberance, the inner seal having an outer dimension greater than the inner diameter of the cavity in the second housing, the inner seals being located intermediate the ends of each protuberance in abutment with an annular shoulder on the exterior of each protuberance having an outer dimension less than the outer dimension of the corresponding inner seal, the inner seal engaging the second connector housing at the inner end when the first and second connector housings are mated, whereby terminals interconnecting corresponding conductors forming each circuit are separately sealed.

* * * * *